US011774069B1

(12) United States Patent
Jiang

(10) Patent No.: US 11,774,069 B1
(45) Date of Patent: Oct. 3, 2023

(54) LIGHT FIXTURE SYSTEM WITH AUTO-ADJUSTABLE INCLINATION ANGLE OF LENS

(71) Applicant: Guangzhou Haoyang Electronic Co., Ltd., Shi Ji Town (CN)

(72) Inventor: Weikai Jiang, Shi Ji Town (CN)

(73) Assignee: GUANGZHOU HAOYANG ELECTRONIC CO., LTD., Guangdong (CN)

( * ) Notice: Subject to any disclaimer, the term of this patent is extended or adjusted under 35 U.S.C. 154(b) by 0 days.

(21) Appl. No.: 18/148,981

(22) Filed: Dec. 30, 2022

Related U.S. Application Data

(63) Continuation of application No. PCT/CN2022/112433, filed on Aug. 15, 2022.

(30) Foreign Application Priority Data

Apr. 30, 2022 (CN) ..... 202210468127.0

(51) Int. Cl.
*F21V 14/06* (2006.01)
*F21V 21/15* (2006.01)

(52) U.S. Cl.
CPC ..... *F21V 14/06* (2013.01); *F21V 21/15* (2013.01)

(58) Field of Classification Search
CPC ..... F21V 14/06; F21V 14/065; F21V 21/15; F21V 21/26; F21V 21/28; F21V 21/29
See application file for complete search history.

(56) References Cited

U.S. PATENT DOCUMENTS 7,775,679 B2 * 8/2010 Thrailkill ..... G01N 21/8806 362/240
2017/0074488 A1 * 3/2017 Fujisawa ..... F21S 8/04

* cited by examiner

*Primary Examiner* — Sean P Gramling
(74) *Attorney, Agent, or Firm* — Muncy, Geissler, Olds & Lowe, P.C.

(57) ABSTRACT

A light fixture system with auto-adjustable inclination angle of a lens includes a case, a supporting arm pivotally connected to the case and rotatable in a first dimension, and a light head pivotally connected to the supporting arm and rotatable in a second dimension. The light head is provided with a light source, a light-transmitting lens, and at least three driving mechanisms for driving the light-transmitting lens to move along an outgoing direction of the light source, and the driving mechanisms are independent from each other and not located in the same line. An angle detector is used to monitor an included angle of the light-transmitting lens with respect to the outgoing direction of the light source, when the light-transmitting lens is not perpendicular to the outgoing direction of the light source, the light-transmitting lens is controlled to be perpendicular to the outgoing direction of the light source.

13 Claims, 3 Drawing Sheets

LIGHT FIXTURE SYSTEM WITH AUTO-ADJUSTABLE INCLINATION ANGLE OF LENS

CROSS REFERENCE TO RELATED APPLICATIONS

The present application is a continuation of International Application No. PCT/CN2022/112433, filed on Aug. 15, 2022, which claims priority from Chinese Invention Application No. 202210468127.0 filed on Apr. 30, 2022, all of which are hereby incorporated herein by reference.

TECHNICAL FIELD

The present invention relates to the technical field of stage lighting, and more specifically, to a light fixture system with auto-adjustable inclination angle of a lens.

BACKGROUND

A wash light with a focus function generally achieves focus effects by moving a focus lens thereof back and forth along an outgoing direction of a light source. However, the wash light has multiple light sources, the focus lens is also multiple corresponding the light sources, the area of a mounting plate used to load the multiple focus lenses thus is usually very large. In order to drive the mounting plate to move, three or four motors are generally provided to synchronously drive the mounting plate to move back and forth along the outgoing direction of the light source, and the mounting plate is always perpendicular to the outgoing direction of the light source. However, a head of the wash light will be rapidly rotated during operation, in case of falling caused by sudden power failure or action by an external force, the mounting plate may be inclined, no longer perpendicular to the outgoing direction of the light source, and cannot operate normally, thus affecting focusing and condensing effects.

SUMMARY

In view of this, the present invention thus provides a light fixture system with auto-adjustable inclination angle of a lens, which is capable of adjusting the inclination angle of the lens automatically when the lens is inclined or stuck.

The light fixture system with auto-adjustable inclination angle of a lens according to the present invention includes a case, a supporting arm pivotally connected to the case and rotating in a first dimension, and a light head pivotally connected to the supporting arm and rotating in a second dimension. The light head is provided with a light source, a light-transmitting lens for adjusting a divergence angle of an outgoing light of the light source, and at least three driving mechanisms for driving the light-transmitting lens to move along an outgoing direction of the light source, and the driving mechanisms are independent from each other and not located in the same line. An angle detector is used to monitor an included angle of the light-transmitting lens with respect to the outgoing direction of the light source, and when it is detected that the light-transmitting lens is not perpendicular to the outgoing direction of the light source, a controller controls corresponding driving mechanisms to operate respectively according to the included angle of the light-transmitting lens with respect to the outgoing direction of the light source and adjusts the movement of the light-transmitting lens to be perpendicular to the outgoing direction of the light source.

In the present invention, the light fixture system drives the light-transmitting lens along the outgoing direction of the light source by at least three mutually independent driving mechanisms and monitors the included angle of the light-transmitting lens with respect to the outgoing direction of the light source by the angle detector. Since the driving mechanisms are independent of each other, the controller can independently control operation of the corresponding driving mechanism to restore the lens to an angle perpendicular to the outgoing direction of the light source, thereby solving the stuck problem. Therefore, after the light-transmitting lens is reset, the light-transmitting lens can be moved to the target position again to complete the automatic calibration when stuck.

The angle detector includes a first inclination angle sensor to detect an inclined angle of the light-transmitting lens, the first inclination angle sensor can be moved along with the light-transmitting lens, and the controller adjusts the movement of the light-transmitting lens to be perpendicular to the outgoing direction of the light source according to a detection result of the first inclination angle sensor, in combination with a known outgoing direction of the light source. When the outgoing direction of the light source is known, the first inclination angle sensor is used to determine the inclination angle of the light-transmitting lens, so that combined with the angle of the outgoing direction of the light source, the included angle of the light-transmitting lens with respect to the outgoing direction of the light source can be determined, thereby facilitating the controller to control the corresponding driving mechanism to operate to achieve restoring the light-transmitting lens to the angle perpendicular to the outgoing direction of the light source.

According to the present invention, the first inclination angle sensor can be preferably of a single-axis inclination angle sensor, and the number of the inclination angle sensor can be multiple. The first inclination angle sensor can move along with the light-transmitting lens, and at least three driving mechanisms that are not collinear are connected in series by virtual line, the connection direction of at least two interconnected virtual lines are respectively provided with the first inclination angle sensor for detecting the inclination angle in a respective connection direction. When one of the first inclination angle sensors is adjusted, the height of the driving position (i.e., the height of the connecting position of the light-transmitting lens and the driving shaft of the driving mechanism relative to the height of the driving mechanism) of one of corresponding two driving mechanisms is taken as a standard, the driving position of the other driving mechanism is driven to change until the detection direction of the first inclination angle sensor is perpendicular to the outgoing direction of the light source, and the driving position of the adjusted driving mechanism is kept unchanged to adjust the detection direction of the remaining first inclination angle sensor to be perpendicular to the outgoing direction of the light source.

In the present invention, the first inclination angle sensor is a single-axis inclination angle sensor, and the detection direction of each of the first inclination angle sensors corresponds to the virtual lines of the two driving mechanisms, so the relative height of driving positions of the two driving mechanisms can be determined according to the first inclination angle sensor, which is intuitive and clear, and easy to control. In addition, the first inclination angle sensor is provided in the direction of at least two interconnected virtual lines, that is, the height of the driving positions of at least three driving mechanisms that are not collinear can be sorted and compared, so as to determine the inclination angle of the light-transmitting lens, and the height of the driving positions of at least three driving mechanisms that are not collinear can be adjusted to be consistent using the principle of three points defining a plane thereby achieving restoring the light-transmitting lens the angle perpendicular to the outgoing direction of the light source.

According to the present invention, after the detection directions of all of the first inclination angle sensors are adjusted to be perpendicular to the outgoing direction of the light source, the position of the light-transmitting lens is reset and then driven back to a target position so that the light-transmitting lens can continue previous operations and will not affect the normal use of the light fixture.

According to another possibility of the present invention before the detection direction of the one of the first inclination angle sensor sensors is adjusted, all detection data of the first inclination angle sensor is compared to rank the driving positions of the driving mechanisms from high to low according to the highest or lowest driving position thereof, and the corresponding first inclination angle sensor is taken as a first adjustment target. This makes it possible to specify the driving position of each driving mechanism, acknowledge the approximate inclination state of the light-transmitting lens plate, and drive the remaining driving mechanisms in one direction when adjusting the driving positions thereof.

Or before the detection direction of the first one of the first inclination angle sensors is adjusted, all detection data of the first inclination angle sensor are compared to rank the driving positions of the driving mechanisms from high to low according to a middle driving position thereof, and the corresponding first inclination angle sensor is taken as the first adjustment target. This makes it possible to specify the driving position of each driving mechanism, acknowledge the approximate inclination state of the light-transmitting lens plate, and make the driving positions of all driving mechanisms closer to a standard position when adjusting the driving positions of the remaining driving mechanisms, so as to prevent the stuck problem caused by the excessive adjustment distance while adjusting all driving mechanisms in the same direction.

In case that the height consistency adjustment of the drive positions of two driving mechanisms corresponding to the first one of the first inclination angle sensor is stuck, the light fixture system will jump to the drive positions of two driving mechanisms corresponding to the next one of the first inclination angle sensors for height consistency adjustment. To avoid stuck problem and being unable to proceed to the next step, the first inclination angle sensor corresponding to the two driving mechanisms capable of consistent adjustment is taken as the first one to be adjusted, and then the remaining are adjusted one by one, to make the light-transmitting lens that has stuck move smoothly.

According to the present invention, the angle detector further includes a second inclination angle sensor to detect the outgoing direction of the light source, and the controller weights the detection data of the first inclination angle sensor according to the second inclination angle sensor, so as to deduce the inclined angle of the light-transmitting lens with respect to the outgoing direction of the light source. In this way, it is possible to adjust the light-transmitting lens to be perpendicular to the outgoing direction of the light source, regardless of the outgoing direction of the light source.

During the movement of the light-transmitting lens being adjusted to be perpendicular to the outgoing direction of the light source, and the outgoing direction of the light source is fixed. This facilitates the detection of the inclination angle of the light-transmitting lens.

In order to simplify the calculation, before the angle detector is used to detect the included angle of the light-transmitting lens with respect to the outgoing direction of the light source, the second inclination angle sensor is firstly used to adjust the outgoing direction of the light source to vertical. In this way, when the detection result of the first inclination angle sensor is processed, there is no need to weight the detection data of the second inclination angle sensor, which makes calculation easier.

According to the present invention, the second inclination angle sensor may be provided in the lamp holder, and an included angle of the second inclination angle sensor with respect to the outgoing direction of the light source is fixed. The outgoing direction of the light source can be known directly from the detection result of the second inclination angle sensor.

While the second inclination angle sensor can also be provided in the supporting arm, and an included angle of the second inclination angle sensor with respect to a pivot axis of the light head is fixed, and the second inclination angle sensor cooperates with a rotation angle detector of the light head to detect the outgoing direction of the light source.

Or the second inclination angle sensor is provided in the case and an included angle of the second inclination angle sensor with respect to a pivot axis between the supporting arm and the case is fixed, and the second inclination angle sensor cooperates with rotation angle detectors of the light head and the supporting arm to detect the outgoing direction of the light source. When the second inclination angle sensor is provided in the case, the hanging state of the stage lights can be directly known, facilitating the control of other components.

DETAILED DESCRIPTION

Figure 1:
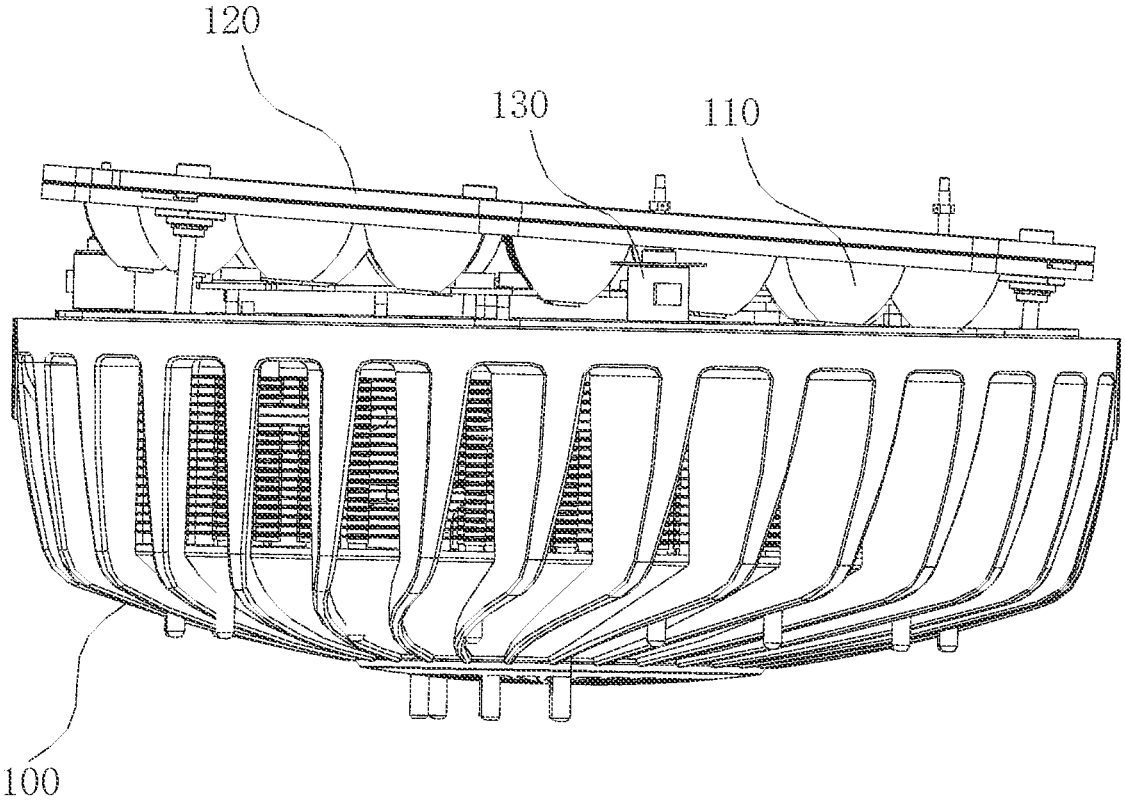
FIG. 1 is a schematic diagram of structure of a light-transmitting lens inclined in a light head according to one embodiment of the present invention.

The drawings are only for exemplary illustration and cannot be construed as a limitation of the present invention. To better explain the present embodiments, some components of the drawings may be omitted, enlarged, or reduced, but do not represent the size of an actual product. It is understandable for those skilled in the art that some well-known structures and descriptions thereof in the drawings may be omitted. The description of positional relationships in the drawings is merely for exemplary illustration and cannot be understood as a limitation of the present invention.

Figure 2:
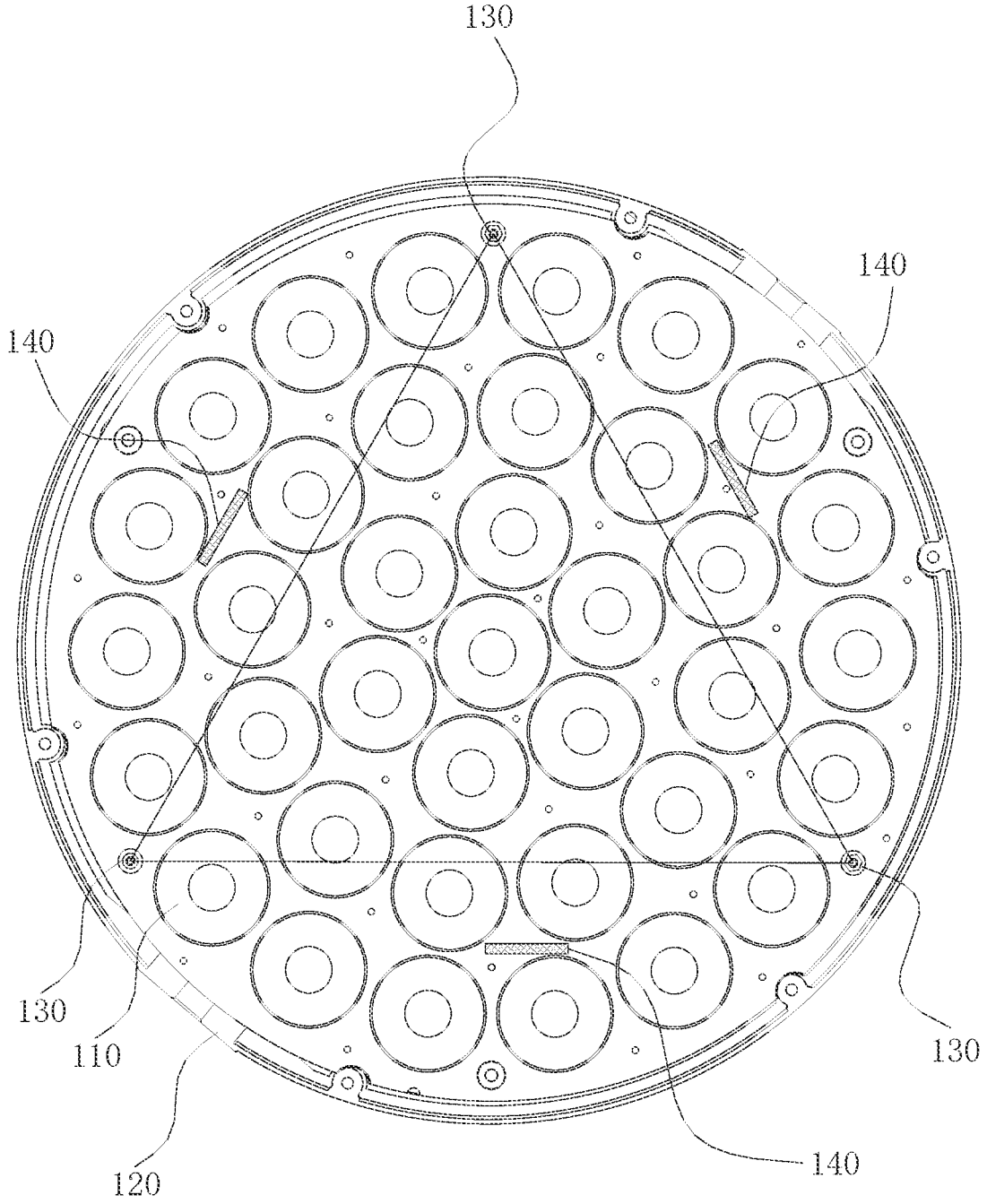
FIG. 2 is a front view of the light-transmitting lens shown in FIG. 1.
Figure 3:
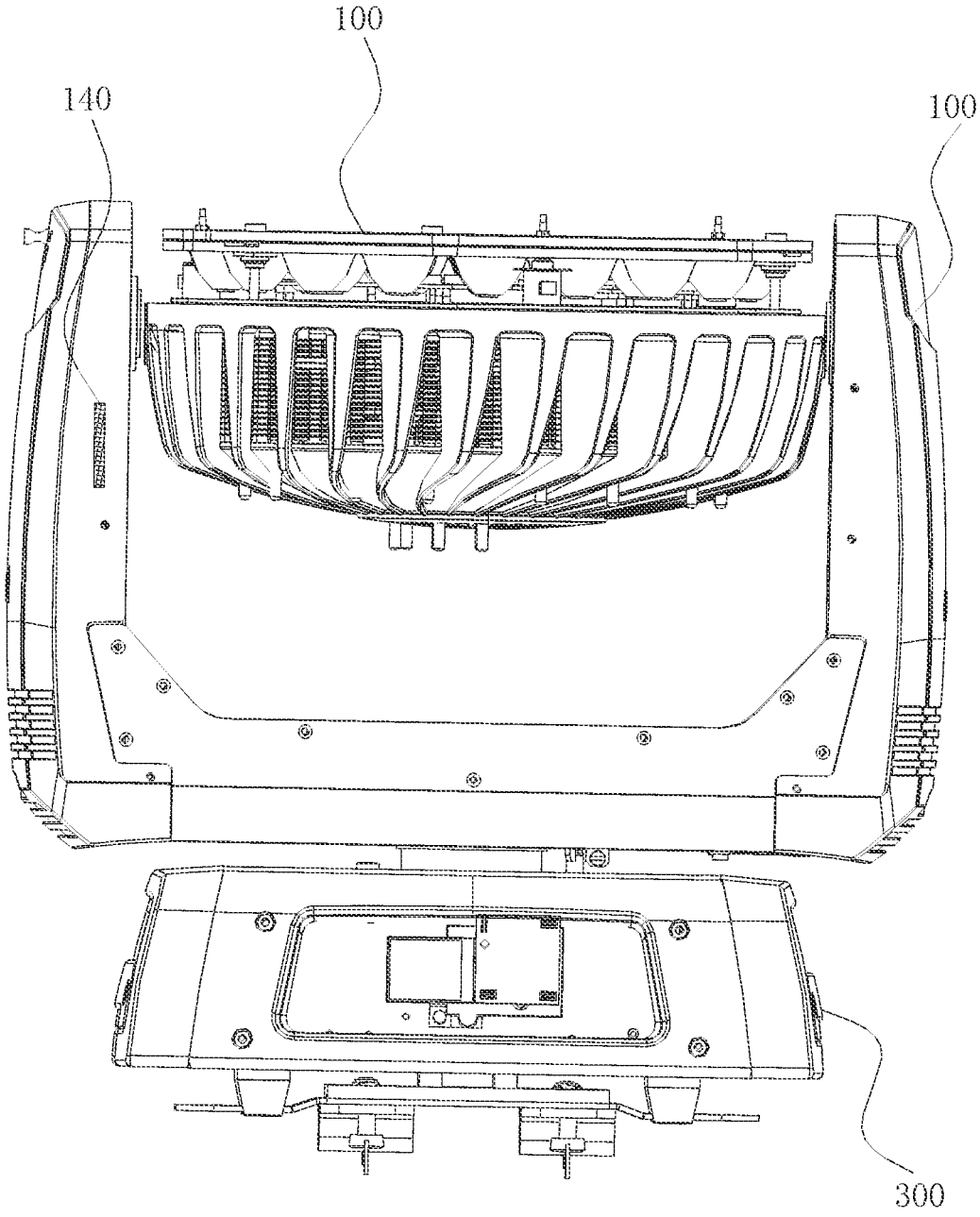
FIG. 3 is a schematic diagram of the overall structure of a light fixture according to one embodiment of the present invention.

Referring to FIGS. 1 to 3, a light fixture system with auto-adjustable inclination angle of a lens is provided according to an embodiment of the present invention, which includes a case 300, a supporting arm 200 pivotally connected to the case 300 and capable of rotating in a first dimension, and a light head 100 pivotally connected to the supporting arm 200 and rotating in a second dimension. The light head 100 is provided with a light source, a light-transmitting lens 110 for adjusting a divergence angle of an outgoing light of the light source, and at least three driving mechanisms 130 for driving the light-transmitting lens 110 to move along an outgoing direction of the light source. The driving mechanisms 130 are independent from each other and not located in the same line. According to the present invention, an angle detector is configured to monitor an included angle of the light-transmitting lens 110 with respect to the outgoing direction of the light source, and when it is detected that the light-transmitting lens 110 is not perpendicular to the outgoing direction of the light source, a controller controls corresponding driving mechanisms 130 to operate respectively according to the included angle of the light-transmitting lens 110 with respect to the outgoing direction of the light source and adjust the movement of the light-transmitting lens 110 to be perpendicular to the outgoing direction of the light source.

The light fixture system in the present embodiment can drive the light-transmitting lens 110 along the outgoing direction of the light source by at least three mutually independent driving mechanisms 130 and monitors the included angle of the light-transmitting lens 110 with respect to the outgoing direction of the light source by the angle detector. Since the driving mechanisms 130 are independent of each other, the controller can independently control operation of the corresponding driving mechanism 130 to restore the lens to an angle perpendicular to the outgoing direction of the light source, thereby solving the stuck problem. Therefore, after the light-transmitting lens 110 is reset, the light-transmitting lens can be moved to the target position again to complete the automatic calibration when stuck.

Normally, the outgoing direction of the light source is perpendicular to the mounting plate 120 of the light source, in the present embodiment, the inclined angle of the light-transmitting lens 110 with respect to the outgoing direction of the light source is indirectly obtained by the angle detector by detecting the inclined angle of the light-transmitting lens 110 with respect to the mounting plate 120 of the light source.

The angle detector includes a first inclination angle sensor 140 which is configured to detect an inclined angle of the light-transmitting lens 110, the first inclination angle sensor 140 can be moved along with the light-transmitting lens 100, the controller adjusts the movement of the light-transmitting lens 140 to be perpendicular to the outgoing direction of the light source according to a detection result of the first inclination angle sensor 140, in combination with a known outgoing direction of the light source. The first inclination angle sensor 140 is used to detect the inclined angle of the light-transmitting lens 110 with respect to the horizontal plane or vertical plane, which is a well-known component and can be obtained by purchase, such as gyroscopes, accelerometers, gradiometers and the like. When the light-transmitting lens 110 is inclined, the first inclination angle sensor 140 will also be inclined, so when the outgoing direction of the light source is known, the first inclination angle sensor can determine the inclination angle of the light-transmitting lens 110, so that combined with the angle of the outgoing direction of the light source, the included angle of the light-transmitting lens 110 with respect to the outgoing direction of the light source can be determined, thereby facilitating the controller to control the corresponding driving mechanism 130 to operate to achieve restoring the light-transmitting lens 130 to the angle perpendicular to the outgoing direction of the light source.

When the light head 100 is placed horizontally for use, and the outgoing direction of the light source is vertical, or the outgoing direction of the light source is known, the inclined angle of the light-transmitting lens 110 with respect to the outgoing direction of the light source can be calculated using only the first inclination angle sensor 140.

The first inclination angle sensor 140 is preferably of a single-axis inclination angle sensor to detect an inclination angle in a specific direction, and the number of the inclination angle sensor can be multiple. the first inclination angle sensor 140 can move along with the light-transmitting lens 110. As shown in FIG. 2, at least three driving mechanisms 130 that are not collinear are connected in series by virtual lines, the connection direction of at least two interconnected virtual lines are respectively provided with the first inclination angle sensor 140 for detecting the inclination angle. When one of the first inclination angle sensors 140 is adjusted, the height of the driving position (i.e., the height of the connecting position of the light-transmitting lens 110 and the driving shaft of the driving mechanism 130 relative to the height of the driving mechanism 130) of one of corresponding two driving mechanisms 130 is taken as a standard, the driving position of the other driving mechanism 130 is driven to change until the detection direction of the first inclination angle sensor 140 is perpendicular to the outgoing direction of the light source. The driving position of the adjusted driving mechanism 130 is kept unchanged to adjust the detection direction of the remaining first inclination angle sensor 140 to be perpendicular to the outgoing direction of the light source.

According to the present embodiment, the first inclination angle sensor 140 is a single-axis inclination angle sensor, and the detection direction of each the first inclination angle sensor 140 corresponds to the virtual lines of the two driving mechanism 130, so the relative height of driving positions of the two driving mechanism 130 can be determined according to the first inclination angle sensor 140, which is intuitive and clear, and easy to control. In addition, the first inclination angle sensor 140 is provided in the direction of at least two interconnected virtual lines, that is, the height of the driving positions of at least three driving mechanisms 130 that are not collinear can be sorted and compared, so as to determine the inclination angle of the light-transmitting lens 110, and the height of the driving positions of at least three driving mechanisms 130 that are not collinear can be adjusted to be consistent using the principle of three points defining a plane thereby achieving restoring the light-transmitting lens 110 the angle perpendicular to the outgoing direction of the light source.

Alternatively, when at least three driving mechanisms 130 that are not collinear are connected in series by virtual lines, it is not necessary to form a closed loop, that is, the head and tail of the lines may not be connected.

After the detection directions of all of the first inclination angle sensors 140 are adjusted to be perpendicular to the outgoing direction of the light source, the position of the light-transmitting lens 110 is reset and then driven back to a target position, so that the light-transmitting lens 110 can continue previous operations and will not affect the normal use of the light fixture.

According to one embodiment, before the detection direction of the first one of the first inclination angle sensors 140 is adjusted, all detection data of the first inclination angle sensor 140 is compared to rank the driving positions of the driving mechanisms 130 from high to low according to the highest or lowest driving position thereof, and the corresponding first inclination angle sensor 140 is taken as a first adjustment target. This makes it possible to specify the driving position of each driving mechanism 130, to acknowledge the approximate inclination state of the light-transmitting lens plate, and to drive the remaining driving mechanisms 130 in one direction when adjusting the driving positions thereof.

In another embodiment, before the detection direction of the first one of the first inclination angle sensors 140 is adjusted, all detection data of the first inclination angle sensor 140 are compared to rank the driving positions of the driving mechanisms 130 from high to low according to a middle driving position thereof, and the corresponding first inclination angle sensor 140 is taken as the first adjustment target. This makes it possible to specify the driving position of each driving mechanism 130, to acknowledge the approximate inclination state of the light-transmitting lens plate, and to make the driving positions of all driving mechanisms 130 closer to a standard position when adjusting the driving positions of the remaining driving mechanisms, so as to prevent the stuck problem caused by the excessive adjustment distance while adjusting all driving mechanisms in the same direction.

Alternatively, when the driving mechanism 130 corresponds to two first inclination angle sensors 140, any one of them is selected as the first adjustment target.

In case that the height consistency adjustment of the drive positions of two driving mechanisms 130 corresponding to the first one of the first inclination angle sensor 140 is stuck, the light fixture system jumps to the drive positions of two driving mechanisms 130 corresponding to the next one of the first inclination angle sensors 140 for height consistency adjustment. To avoid stuck problem and being unable to proceed to the next step, the first inclination angle sensor 140 corresponding to the two driving mechanisms 130 capable of consistent adjustment is taken as the first one to be adjusted, and then the remaining are adjusted one by one, to make the light-transmitting lens 110 that has stuck move smoothly.

When there are odd-numbered drive mechanisms 130 corresponding to the first inclination angle sensor 140, the driving position whose relative height is in the middle is taken as the standard, and when there are even-numbered driving mechanisms 130 corresponding to the first inclination angle sensor 140, either of the two driving positions whose relative height is in the middle is taken as the standard.

Preferably, when all of the driving mechanisms 130 are connected in series with virtual lines, the first inclination angle sensor 140 is provided in the direction of each virtual line. All the driving mechanisms 130 actively perform the height consistency adjustment of the driving position, so that even if the area of the mounting plate 120 for mounting the light-transmitting lens 110 is too large and deformed, it can still ensure that all light-transmitting lens 110 are perpendicular to the outgoing direction of the light source.

In a preferred embodiment of the present invention, all driving mechanisms 130 are connected with virtual lines along the circumference of the light-transmitting lens 110. The driving positions of the driving mechanism 130 is adjusted sequentially along the circumference of the light-transmitting lens 110, which prevents repeated cross-adjustment and has higher adjustment efficiency.

As shown in FIG. 2, there are three driving mechanisms 130, distributed as an equilateral triangle, and in the direction of the virtual line of any two adjacent driving mechanisms 130 is correspondingly provided with a first inclination angle sensor 140 for detecting the inclination angle in that direction. Considering the size of the present light fixture, three driving mechanisms 130 are usually used to drive the light-transmitting lens 110, and one first inclination angle sensor 140 is provided in the length direction of each of three sides of the triangle defined by three driving mechanisms 130, allowing to compare the height of the driving positions of any two adjacent driving mechanisms 130.

Two driving mechanisms 130 of the first inclination angle sensor 140 can be provided in the direction of the virtual line at an included angle formed with respect to the center of the light-transmitting lens 110 greater than or equal to 45°. When the interval between the two driving mechanisms 130 is too small, it is difficult for the two driving mechanisms 130 to change the height of the entire light-transmitting lens 110 by driving a local part of the light-transmitting lens 110, which will also cause a local stress of the light-transmitting lens 110 to be too large.

Alternatively, the two driving mechanisms 130 of the first inclination angle sensor 140 can be provided in the direction of the virtual line at an included angle formed with respect to the center of the light-transmitting lens 110 greater than or equal to 60°.

When there are a plurality of the light-transmitting lens 110, it is required that the included angle of the center where the light-transmitting lens 110 is distributed with respect to the two driving mechanisms 130 is greater than or equal to 45°.

A mounting plate 120 is further included for fixing the light-transmitting lens 110, and the first inclination angle sensor 140 is provided around the light-transmitting lens 110 located at the center of the mounting plate 120. Since the angle detector generally tends to be provided at the center of the inspected member, and the light-transmitting lens 110 is usually provided at the center of the mounting plate 120, the angle detector includes a plurality of first inclination angle sensors 140, each of which is a single-axis inclination angle sensor, and the first inclination angle sensors 140 are provided around the light-transmitting lens 110 located at the center of the mounting plate 120 to achieve detection of the inclination angle of the mounting plate 120 without occupying the position in the center.

Alternatively, the light-transmitting lens 110 can be arranged to be a plurality of concentric rings on the mounting plate 120, and each concentric ring can be further provided with a light-transmitting lens 110 at the center thereof.

Alternatively, the first inclination angle sensor 140 is located on one side of the mounting plate 120 near the light source.

The angle detector further includes a second inclination angle sensor 310 to detect the outgoing direction of the light source, and the controller weights the detection data of the first inclination angle sensor 140 according to the second inclination angle sensor 310, so as to deduce the inclined angle of the light-transmitting lens 110 with respect to the outgoing direction of the light source. In this way, it is possible to adjust the light-transmitting lens 110 to be perpendicular to the outgoing direction of the light source, regardless of the outgoing direction of the light source. The second inclination angle sensor 310 is used to detect the included angle of the outgoing direction of the light source with respect to the horizontal plane or vertical plane, which is a well-known component, and can be obtained by purchase, such as gyroscopes, accelerometers, gradiometers and the like.

During the movement of the light-transmitting lens 110 being adjusted to be perpendicular to the outgoing direction of the light source, the outgoing direction of the light source is better to be fixed. This facilitates the detection of the inclination angle of the light-transmitting lens 110.

In order to simplify the calculation, before the angle detector is used to detect the included angle of the light-transmitting lens 110 with respect to the outgoing direction of the light source, the second inclination angle sensor 310 is firstly used to adjust the outgoing direction of the light source to vertical. In this way, when the detection result of the first inclination angle sensor 140 is processed, there is no need to weight the detection data of the second inclination angle sensor 310, which makes the easier.

In a preferred embodiment of the present invention, the second inclination angle sensor 310 is provided in the light head 100, and an included angle of the second inclination angle sensor 310 with respect to the outgoing direction of the light source is fixed. The outgoing direction of the light source thus can be known directly from the detection result of the second inclination angle sensor 310.

The second inclination angle sensor 310 can be used to adjust the outgoing direction of the light source to vertical to facilitate the first inclination angle sensor 140 to detect the inclined angle of the light-transmitting lens 110 to the outgoing direction of the light source.

While the second inclination angle sensor 310 can also be provided in the supporting arm 200, and an included angle of the second inclination angle sensor 310 with respect to a pivot axis of the light head 100 is fixed, and the second inclination angle sensor 310 cooperates with a rotation angle detector of the light head 100 to detect the outgoing direction of the light source.

The second inclination angle sensor 310 can be provided in the case 300 and an inclined angle of the second inclination angle sensor with respect to a pivot axis between the supporting arm 200 and the case 300 is fixed, and the second inclination angle sensor 310 cooperates with rotation angle detectors of the light head 100 and the supporting arm 200 to detect the outgoing direction of the light source. When the second inclination angle sensor 310 is provided in the case 300, the hanging state of the stage light fixture can be directly known, facilitating the control of other components.

Apparently, the above embodiments of the present invention are merely examples for clearly illustrating the present invention, but not are meant to limit the implementations of the present invention. A person of ordinary skill in the art may further make other changes or variations in a different form on the basis of the above description. Herein, examples are unnecessarily provided for all implementation manners. Any modification, equivalent replacement, improvement and the like made within the spirit and principle of the present invention should be included in the scope of protection of the claims of the present invention.

What is claimed is:

1. A light fixture system with auto-adjustable inclination angle of a lens, comprising a case;

a supporting arm, which is pivotally connected to the case and is rotatable in a first dimension; and a light head, which is pivotally connected to the supporting arm and is rotatable in a second dimension, wherein the light head is provided with a light source, a light-transmitting lens for adjusting a divergence angle of an outgoing light of the light source, and at least three driving mechanisms for driving the light-transmitting lens to move along an outgoing direction of the light source, and the driving mechanisms are independent from each other and not located in the same line, wherein an angle detector is configured to monitor an inclined angle of the light-transmitting lens with respect to the outgoing direction of the light source, and when it is detected that the light-transmitting lens is not perpendicular to the outgoing direction of the light source, a controller controls corresponding driving mechanisms to operate respectively according to the included angle of the light-transmitting lens with respect to the outgoing direction of the light source and adjusts the movement of the light-transmitting lens to be perpendicular to the outgoing direction of the light source.

2. The light fixture system according to claim 1, wherein the angle detector comprises a first inclination angle sensor to detect a inclination angle of the light-transmitting lens, the first inclination angle sensor is configured to move along with the light-transmitting lens, the controller is configured to adjust movement of the light-transmitting lens to be perpendicular to the outgoing direction of the light source according to a detection result of the first inclination angle sensor, in combination with a known outgoing direction of the light source.

3. The light fixture system according to claim 2, wherein the first inclination angle sensor is of a plurality of single-axis inclination angle sensors, the first inclination angle sensor is configured to move along with the light-transmitting lens, and at least three driving mechanisms that are not collinear are connected in series by virtual lines, the first inclination angle sensor for detecting an inclination angle is provided along a connection direction of at least two interconnected virtual lines;

when a first one of the single-axis inclination angle sensors is adjusted, a height of a driving position of one of corresponding two driving mechanisms is taken as a standard, a driving position of the other driving mechanism is driven to change until a detection direction of the first inclination angle sensor is perpendicular to the outgoing direction of the light source, and the driving position of the adjusted driving mechanism is kept unchanged to adjust the detection direction of the remaining first inclination angle sensor to be perpendicular to the outgoing direction of the light source.

4. The light fixture system according to claim 3, wherein after the detection directions of all of the first inclination angle sensors are adjusted to be perpendicular to the outgoing direction of the light source, the light-transmitting lens is reset and then driven back to a target position.

5. The light fixture system according to claim 3, wherein before the detection direction of the first one of the single-axis inclination angle sensors is adjusted, all detection data thereof is compared to rank the driving positions of the driving mechanisms from high to low according to a highest or lowest driving position thereof, and the corresponding single-axis inclination angle sensor is taken as a first adjustment target.

6. The light fixture system according to claim 3, wherein before the detection direction of the first one of the single-axis inclination angle sensors is adjusted, all detection data thereof are compared to rank the driving positions of the driving mechanisms from high to low according to a middle driving position thereof, and the corresponding single-axis inclination angle sensor is taken as a first adjustment target.

7. The light fixture system according to claim 3, wherein in case that a height consistency adjustment of the drive positions of two driving mechanisms corresponding to the first one of the single-axis inclination angle sensors is stuck, the light fixture system is configured to jump to the drive positions of two driving mechanisms corresponding to the next one of the single-axis inclination angle sensors for height consistency adjustment.

8. The light fixture system according to claim 2, wherein the angle detector further comprises a second inclination angle sensor to detect the outgoing direction of the light source, and the controller is configured to weight detection data of the first inclination angle sensor according to the second inclination angle sensor, so as to deduce the included angle of the light-transmitting lens with respect to the outgoing direction of the light source.

9. The light fixture system according to claim 8, wherein during the movement of the light-transmitting lens being adjusted to be perpendicular to the outgoing direction of the light source, the outgoing direction of the light source is fixed.

10. The light fixture system according to claim 8, wherein before the angle detector is used to detect the included angle of the light-transmitting lens with respect to the outgoing direction of the light source, the second inclination angle sensor is firstly used to adjust the outgoing direction of the light source to be vertical.

11. The light fixture system according to claim 8, wherein the second inclination angle sensor is provided in the light head, and an inclined angle of the second inclination angle sensor with respect to the outgoing direction of the light source is fixed.

12. The light fixture system according to claim 8, wherein the second inclination angle sensor is provided in the supporting arm, and an included angle of the second inclination angle sensor with respect to a pivot axis of the light head is fixed, and the second inclination angle sensor is cooperated with a rotation angle detector of the light head to detect the outgoing direction of the light source.

13. The light fixture system according to claim 8, wherein the second inclination angle sensor is provided in the case and an included angle of the second inclination angle sensor with respect to a pivot axis between the supporting arm and the case is fixed, and the second inclination angle sensor is cooperated with a rotation angle detector of the light head and the supporting arm to detect the outgoing direction of the light source.

* * * * *